US005237711A

United States Patent [19]

Mortensen

[11] Patent Number: 5,237,711

[45] Date of Patent: Aug. 24, 1993

[54] MULTIPLE FLUSH TOILET VALVE ASSEMBLY

[76] Inventor: La Vaughn L. Mortensen, 10533 San Ansekmo Ave., South Gate, Calif. 90280

[21] Appl. No.: 965,615

[22] Filed: Oct. 22, 1992

Related U.S. Application Data

[63] Continuation-in-part of Ser. No. 697,239, Apr. 29, 1991, abandoned.

[51] Int. Cl.[5] ..... E03D 1/14; E03D 1/35

[52] U.S. Cl. ..... 4/325; 4/393; 4/394

[58] Field of Search ..... 4/324, 325, 326, 327, 4/381, 382, 393, 394, 395, 399, 413, 414, 415, 400

[56] References Cited

U.S. PATENT DOCUMENTS

| | | | |
|---|---|---|---|
| 1,349,267 | 8/1920 | Craig | 4/394 |
| 2,190,160 | 2/1940 | Mason et al. | 4/414 |
| 2,709,263 | 5/1955 | Doty | 4/325 X |
| 3,117,323 | 1/1964 | Corsaw | 4/400 |
| 3,958,281 | 5/1976 | Remmel | 4/395 X |
| 3,964,109 | 6/1976 | Street et al. | 4/394 X |
| 4,135,263 | 1/1979 | Anderson | 4/394 X |
| 4,155,128 | 5/1979 | Dyer | 4/400 X |
| 4,160,294 | 7/1979 | Crumby | 4/394 X |
| 4,184,215 | 1/1980 | Birdsall | 4/393 X |
| 4,328,596 | 5/1982 | Renz | 4/327 X |
| 4,388,736 | 6/1983 | Roosa et al. | 4/393 X |
| 4,782,537 | 11/1988 | Kinslow | 4/324 |
| 4,953,237 | 9/1990 | Perkins | 4/324 |

*Primary Examiner*—Henry J. Recla
*Assistant Examiner*—Robert M. Fetsuga
*Attorney, Agent, or Firm*—John P. Halvonik

[57] ABSTRACT

An improved toilet flush valve for variable volume toilet flushing systems. The present improvement uses a float adjustable attached to a flapper valve by a rigid stem to vary the flush volume. The stem and flapper valve eliminate the need for a valve item guide to maintain the valve stem vertical as the stem is movably retained through an aperture in the flapper valve. Several embodiments are disclosed.

2 Claims, 1 Drawing Sheet

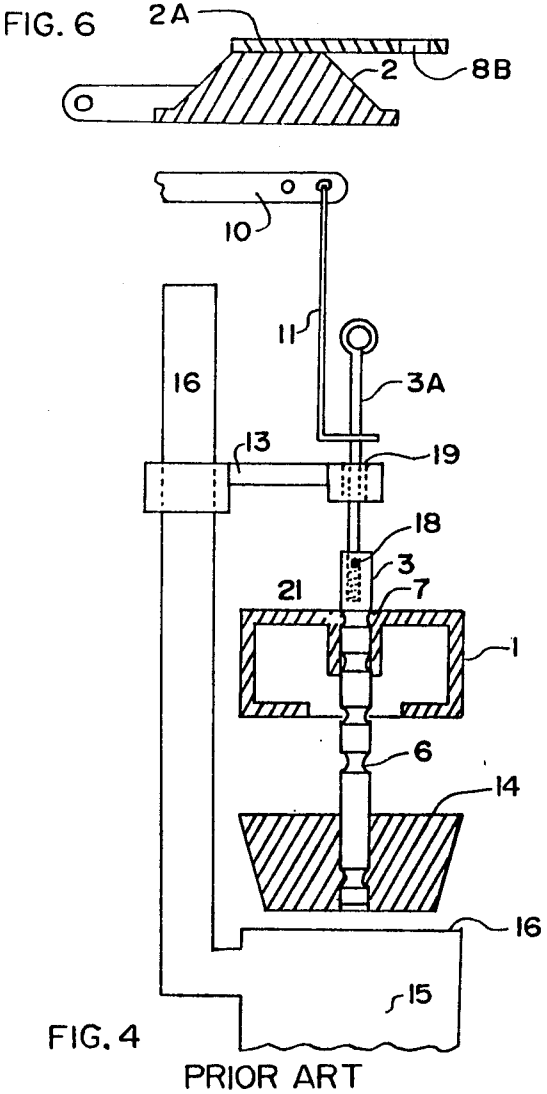
FIG. 6
FIG. 4
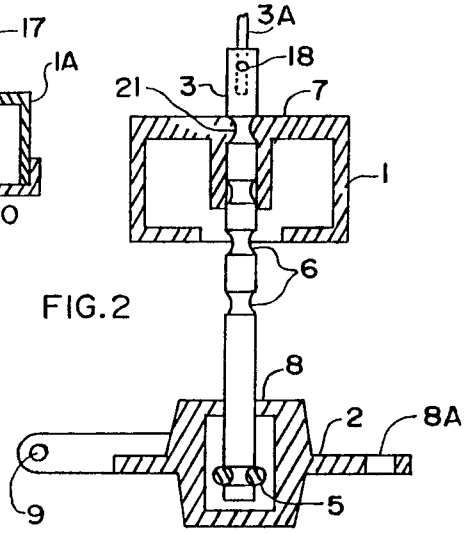
FIG. 2
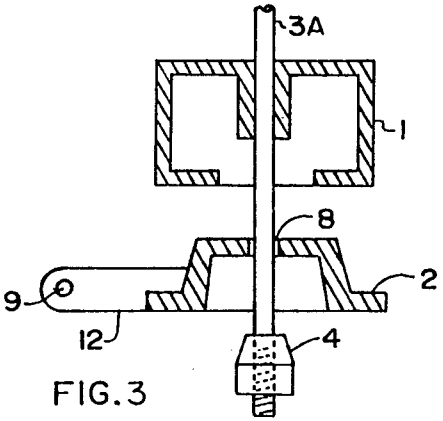
FIG. 3
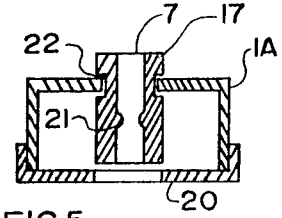
FIG. 5
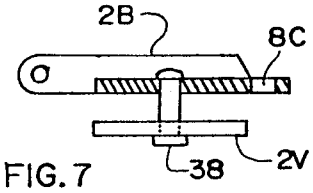
FIG. 7
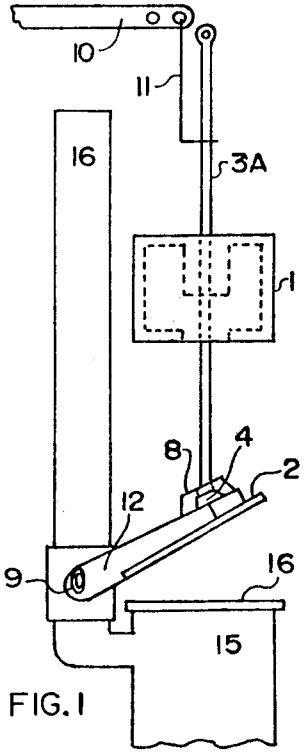
FIG. 1

MULTIPLE FLUSH TOILET VALVE ASSEMBLY

This is a continuation-in-part of application Ser. No. 07/697,239, filed Apr. 29, 1991, now abandoned.

BACKGROUND OF THE INVENTION

Field of the Invention

The invention relates to the field of toilet flushing systems that utilize a floating connection in connection with the valve stem of the flapper flush valve to provide a variable amount of water per flush. The amount of water consumed per flush in these devices is determined by the amount of time one holds down the flush handle. The float can be set so that a normal depressing and releasing of the handle will produce a flush with the absolute minimum of water used. Larger volumes can be used to flush by holding the handle down for longer periods of time. In the present invention, a float is provided that is slidable along the valve stem to maintain the valve stem in vertical position throughout the flush without the need for a valve stem guide.

In most toilet apparatus of this type, it is necessary that the float that is in contact with the flapper valve (as opposed to the float in connection with the inlet valve for refilling the tank be partially buoyant and able to be lifted straight up, away from the flapper valve seat, so that its buoyancy will keep the valve open for a time to permit flushing. To achieve this, most prior art devices provide for a guide means in connection with this float to assure that it moves straight upward. See for example U.S. Pat No. 4,183,107. The present invention eliminates the need for this guide means. The term flush valve properly includes a pivotal flapper in connection with a discharge opening. The flapper is simply a pivotal stopper for the opening, "flapper value" as used in this spec to refer to the flapper alone.

SUMMARY OF THE INVENTION

An improved toilet flushing apparatus of the type that provide variable amount of water per flush. The improvement resides in the use of a sliding valve stem having a stop attached thereto that is slidable up and down through an aperture in the flush valve. The sliding valve stem and the float in connection with it maintain the vertical position of the stem as water level in the tank begins raising the float to its normal resting position upon the refilling of the tank.

It is the object of this invention to eliminate the need for a flush valve stem guide in toilet flushing apparatus with variable flush volume control using a flapper valve.

Another objective of the invention is to provide an apparatus to maintain the flush valve stem in a vertical position at all times in a toilet with variable flush volume control.

Other advantages of the invention should be readily apparent to those skilled in the art once the invention has been described.

DESCRIPTION OF THE FIGURES

FIG. 1 shows the overall design used with a flapper valve.

FIG. 2 shows a partial cutaway, with annular grooves, along the length of part 3 and a flapper valve having a centrally located cavity and an alternate position for the aperture 8A.

FIG. 3 shows a close up view of the float, flapper valve and valve stem.

FIG. 4 shows the prior art with valve stem guide means 13 and an adjustable flush valve 14 in relation to valve stem 3 or 3A.

FIG. 5 is a buoyant float composed of 3 parts.

FIG. 6 and FIG. 7 show alternate positions for the apertures 8B and 8C for the valve stem, FIG. 7 is a washer type flush valve and 2V is a rubber (or similar material) washer that seals against 3B at rest. FIG. 6 is a flapper valve with an extended top portion so that the aperture 8B is extended away from the central portion of the flapper valve.

DESCRIPTION OF THE PREFERRED EMBODIMENT

The invention may be used as part of a kit for retrofitting attachments on existing toilet flush mechanism that are of the type that may be adjusted for giving smaller flushes. The amount of water to be used in a flush may be varied by positioning the float 1 at higher or lower points along the stem 3 or 3A a higher position gives a smaller flush.

By trial and error, one may arrive at that position along the stem which will provide a flush that uses the minimum amount of water necessary to flush. The float may be frictionally set at this position for future quick flushes. One may increase this flush volume by holding the flush handle down for some period of time greater than the normal push and release (quick flush). Fuller flushes are achieved by a longer hold down on the handle.

Usually, a chain or rod or other flexible means 11 connects the flush handle (10) to a position near the top of the valve stem 3A so that movement of the flush handle will result in the lifting of the flush valve and release the water in the toilet tank. The float 1 is just buoyant enough so that it will not hold up the flapper valve 2 when at rest in the tank, but will keep the valve open for a short time after starting the initial flush to insure that the proper amount of water is let out to allow a flush. It is held by its own natural buoyancy and will hold up the valve until the water level in the tank lowers and the float falls with the water level. This allows the flapper to fall and close the flush valve to allow the tank to refill by a refilling means.

In prior art toilet mechanisms of the variable flush variety, shown in FIG. 4, the valve stem may tilt in relation to the flush valve and as such must be supported by a guide 13 to keep it in the vertical position. The present invention also utilizes a movable valve stem but, in this application, without the guide. To prevent the valve stem from tipping over in lieu of the stem guide, the stem 3A is permitted to move through an aperture 8 in the flush valve 2 during the lowering of the float 1 after the initial flush. The flapper valve (or flush valve) is non-buoyant and is pivotally connected to the bottom of the toilet tank.

The flush valve stem 3A provides a rigid vertical attachment of the flush valve 2 to the flushing handle 10. "Rigid" in the sense that the rod is rigid, the connection between the stem and the valve is not that connection is slidable. The end 4 of the rod 3A can move down through the seal opening or aperture 8 in the flush valve so that the rod 3A will move downward, after the water level falls below the float 1.

When in the rest position, before and immediately after an initial flushing actuation the end 4 fits against the opening 8 and forms a seal that does not leak. When the toilet is flushed initially, the handle moves the stem, float, and flush valve upward and water exits the flush valve. As the water level falls below the float, the stem moves downward through the aperture and the float 1 will fall also at this time. Once the flush valve is sealed again, the float 1 will gradually move upward as the water fills the tank. At the same time, the bottom 4 of the rod 3A will come up in connection with the aperture until it eventually reaches the seal opening 8, again, where it will be sealed until the next flush.

The end of the stem 4 is made so that it will form a seal with opening 8 as the rod moves up when the rise in the water level raises the float 1 and stem 3A.

The amount of volume for each flush may be regulated through the use of the sliding float by placing the sliding float at different heights along the stem. The higher up along the stem that the float is attached then the sooner that the water level will fall to the level of the float, when that happens, the valve will soon close as the water level falls a little more. When the float is lower on the stem, the water level will fall a long way before reaching the float and thus a greater volume of water will escape before the flush valve closes. In this way, the volume of flush may be varied.

Note that the aperture 8 is so small as to have little or no effect on the water level. The aperture is just large enough to permit the sliding of the stem without causing a large volume of water to escape and prevent refilling.

When one wishes to retrofit the old toilet, the stem may be replaced by one with (or without) 6 so that the float 1 may be locked into place by frictional engagement with the stem. The valve 4 may be replaced by an O-ring 5 at the end of the stem which engages the aperture 8. Or one can use the valve type shown in FIG. 3. FIG. 5 shows an alternate arrangement for the float 1A which is of three-piece construction, parts 17, 20 and 1A. 17 is a rubberized grommet with a groove 22 which is held in place by the harder piece 1A. 1A can be snap-fit or otherwise fit with bottom piece 20.

In this way, the valve stem is held vertical (or nearly vertical) throughout the filling of the tank and at all other times. The use of the guide rod is not needed. Thus, the device can be used to retrofit onto existing tanks easier. The device can also be retrofit onto tanks with different ends at the stems, e.g. the ball type shown in FIG. 1 or the type shown in FIG. 3. Other obvious means to keep the stem from being pulled upward through the aperture 8 may be used so that the aperture 8 will be sealed.

Note that it is not necessary that the aperture be in the flapper valve, it may be at one side of the flapper valve as shown in FIGS. 6 and 7. There, the aperture is shown as 8B and 8C and it can be seen that it is at one side. In this case, the end of the stem does not need to seal against the aperture. FIGS. 6 and 7 represent two types of flapper valves. That shown in FIG. 7 is known as a "washer type." In FIG. 7 the neck of part 3B is free to move up and down in central aperture of flapper valve 2V thereby making it unnecessary for valve stem 3A to be able to move freely up and down in aperture 8C so that said valve stem 3A and float 1 may remain in a vertical manner at all times. The head of 3B seals against the aperture in washer 2V when the float lifts upper part 2B this causes the sealing of the aperture by the lowering of 2V against the outlet (not shown).

In the present invention, the valve stem guide is not needed to hold the valve stem and float in a vertical manner. When the water in the tank elevates the float, the stem and float are elevated in a vertical position and, when water level is below float, the stem hangs from the lifter arm 10 thereby maintaining the stem and float in a vertical manner at all times.

The small aperture in the flapper replaces the use of a separate valve stem guide.

Note on FIG. 2 that there is an alternate position for the valve stem aperture at 8A. Either the aperture 8 or aperture 8A may be used but only one at a time. 5 in FIG. 2 is a stop to keep the valve stem from coming out of aperture 8, any stop may be used it does not have to seal water tight as the flush valve in FIG. 2 can seal itself against the outlet. The valve stem in FIG. 2 has limited movement within the cavity (note the cavity referred to is below aperture 8 in FIG. 2) through the use of the stop 5.

I claim:

1. An improved flushing assembly for toilet tank flushing assemblies having a tank including a discharge opening, the improvement comprising: a float having a central aperture, a rigid stem having connection means for securing said float in a position along said stem through said central aperture so that said position of said float on said stem may be varied, flexible connection means for connecting said stem to a movable flush lever, a flapper valve for opening and closing said discharge opening, said flapper valve having an aperture therethrough positioned to be in communication with said discharge opening when said flapper valve is closing said discharge opening, said stem extending through said flapper valve aperture in slidable relation therewith, said stem having stop means attached thereto at a position below said flapper valve aperture for sealing said aperture when engaged therewith, whereby said stop means allows lifting of said flapper valve when said lever is moved in one direction where the buoyancy of said float is sufficient to maintain said flapper valve in an open position until the water level in said tank has fallen below said float and the adjustability of said float along said stem provides a variable volume flush.

2. The assembly of claim 1 wherein said flapper valve aperture is located near the enter of said flapper valve.

* * * * *